US005722859A

United States Patent [19]

Chen

[11] Patent Number: 5,722,859

[45] Date of Patent: Mar. 3, 1998

[54] TOTALLY SHIELDED ELECTRICAL JACK ASSEMBLY FOR MODULAR PLUGS

[76] Inventor: Michael Chen, No. 11, Alley 16, Lane 337, Sec. 1, Ta-Tung Rd., Hsi-Chih Chen, Taipei Hsien, Taiwan

[21] Appl. No.: 744,156

[22] Filed: Nov. 12, 1996

[51] Int. Cl.[6] ..... H01R 13/648

[52] U.S. Cl. ..... 439/607; 439/610

[58] Field of Search ..... 439/607–610, 439/676

[56] References Cited

U.S. PATENT DOCUMENTS 4,449,778 5/1984 Lane ..... 439/610
4,671,599 6/1987 Olsson ..... 439/610
4,781,623 11/1988 Philippson et al. ..... 439/610
4,921,441 5/1990 Sauder ..... 439/610

*Primary Examiner*—Hien Vu
*Attorney, Agent, or Firm*—Lowe, Price, LeBlanc & Becker

[57] ABSTRACT

A totally shielded electrical jack assembly adapted for connecting a modular plug to a cable, including a jack frame adapted for receiving the modular plug and having a base and a front box in front of the base, a top cover coupled to and covered on the base of the jack frame, an electrical connector unit mounted inside the jack frame and adapted for electrically connecting the modular plug to the cable, and shield means mounted inside the jack frame, the shield means including a shield frame mounted inside the jack frame, and a cover shell mounted in the top cover, the shield frame and the cover shell being made from metal and coupled together and covered around the electrical connector unit to protect it against magnetic noises.

4 Claims, 12 Drawing Sheets

TOTALLY SHIELDED ELECTRICAL JACK ASSEMBLY FOR MODULAR PLUGS

BACKGROUND OF THE INVENTION

The present invention relates to electrical jack assemblies for modular plugs, and more particularly to a totally shielded electrical jack assembly which meets the specification of FCC (Federal Communications Commission) 68 type.

A variety of electrical connectors, including modular jacks and modular plugs have been developed, and intensively used for connection between cables and computers networks or telecommunication apparatus. These electrical connectors must meet relative specifications defined by Federal Communication Commission. Exemplars of these connectors are seen in U.S. Pat. No. 5,186,647 entitled "HIGH FREQUENCY ELECTRICAL CONNECTOR"; U.S. Pat. No. 5,310,363 entitled "IMPEDANCE MATCHED REDUCED CROSS TALK ELECTRICAL CONNECTOR SYSTEM"; U.S. Pat. No. 5,299,956 entitled "LOW CROSS TALK ELECTRICAL CONNECTOR SYSTEM"; Chinese Pat. Publication No. 224,547 entitled "TELECOMMUNICATION CONNECTOR TERMINAL". These electrical connectors and connector terminal meet the defined specifications, however they have no means to protect against the interference of external magnetic noises. Electrical connectors with shield means are seen in U.S. Pat. No. 5,288,248 entitled "TOTALLY SHIELDED DIN CONNECTOR", U.S. Pat. No. 5,338,215 entitled "JACK ASSEMBLY INCLUDING A CONTACT SWITCHING SYSTEM"; U.S. Pat. No. 5,083,945 entitled "SHIELDED ELECTRICAL CONNECTOR ASSEMBLY"; U.S. Pat. No. 5,480,326 entitled "ELECTRICAL JACK ASSEMBLY FOR MODULAR PLUGS". These electrical connectors commonly have a metal shield covered on the outside to protect against the interference of external magnetic noises. These electrical connectors are functional, however they cannot protect against the interference of static noises when touched by an object. Furthermore, because the metal shield is exposed to the outside, it tends to cause an electric shock when receives a big amount of static electricity and the ambient air is dry, or when in a thunderous day.

SUMMARY OF THE INVENTION

It is one object of the present invention to provide an electrical jack assembly which has a shield means mounted on the inside and kept from sight to protect the contacts between the conductors of the cable and the terminals of the modular plug against the interference of external magnetic noises. It is another object of the present invention to provide an electrical jack assembly which has a shield means mounted within the insulative jack frame thereof to protect the contacts between the conductors of the cable and the terminals of the modular plug against the interference of external magnetic noises. It is still another object of the present invention to provide an electrical jack assembly which has a metal shield means for protection against external magnetic noises, and an insulative jack frame covered around the metal shield means to prevent the metal shield means from causing an electric shock.

BRIEF DESCRIPTION OF THE DRAWINGS

FIG. 2-1 is an exploded view of the electrical jack assembly shown in FIG. 1;

FIG. 2—2 is an elevational view of a part of the present invention, showing the structure of the electrical connector unit;

FIG. 3-1 is a sectional view of the top cover according to the present invention, showing its internal structure;

FIG. 3-2 is a top view of the top cover according to the present invention;

FIG. 3—3 is a right side view of the top cover according to the present invention;

FIG. 4-1 is a sectional view of the cover shell of the shield means according to the present invention, showing its internal structure;

FIG. 4-2 is a top view of the cover shell of the shield means according to the present invention;

FIG. 4-3 is a right side view of the cover shell of the shield means according to the present invention;

FIG. 9-1 is a top view of the terminal mounting base frame according to the present invention;

FIG. 9-2 is a sectional view of the terminal mounting base frame according to the present invention;

FIG. 9-3 is a left side view of the terminal mounting base frame of the present invention, showing the relative positions of the upright blocks and the through holes;

FIG. 9-4 is a right side view of the terminal mounting base frame according to the present invention;

FIG. 10-1 is a top view of a holding-down block according to the present invention;

FIG. 10-2 is a sectional view taken along line A—A of FIG. 10-1;

FIG. 10-3 is a sectional view taken along line B—B of FIG. 10-1;

FIG. 11-1 is a sectional view of the electrical connector unit according to the present invention, showing the holding-down block installed, and the electrical wire secured in place; and, FIG. 11-2 is a partial view in section of the conductor mount of the terminal mounting base frame according to the present invention, showing the conductor of the electrical wire disposed in contact with the forked, sharp tail end of the terminal.

DETAILED DESCRIPTION OF THE PREFERRED EMBODIMENT

Figure 1:
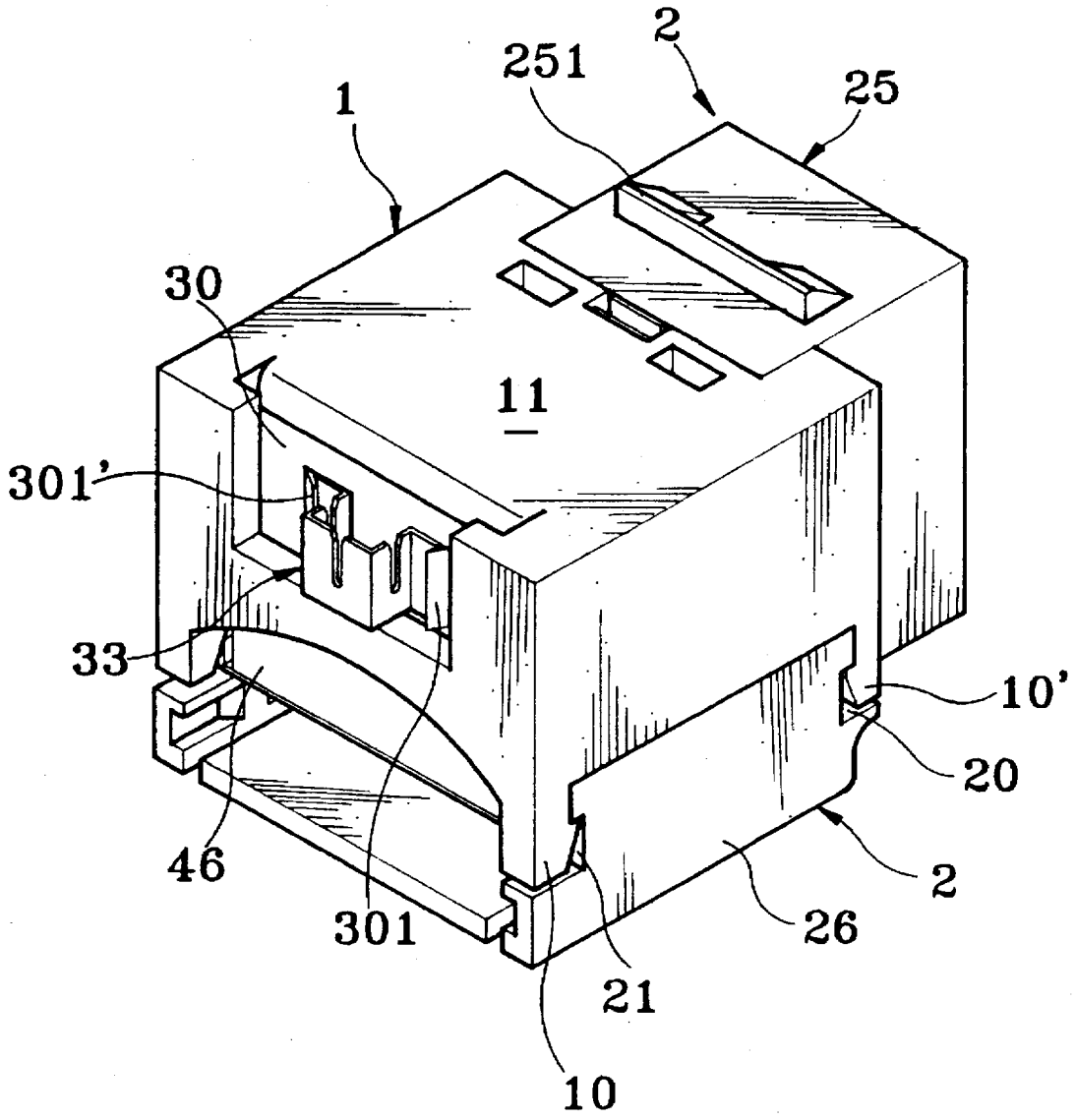
FIG. 1 is an elevational view of an electrical jack assembly according to the present invention.
Figures 1, 2:
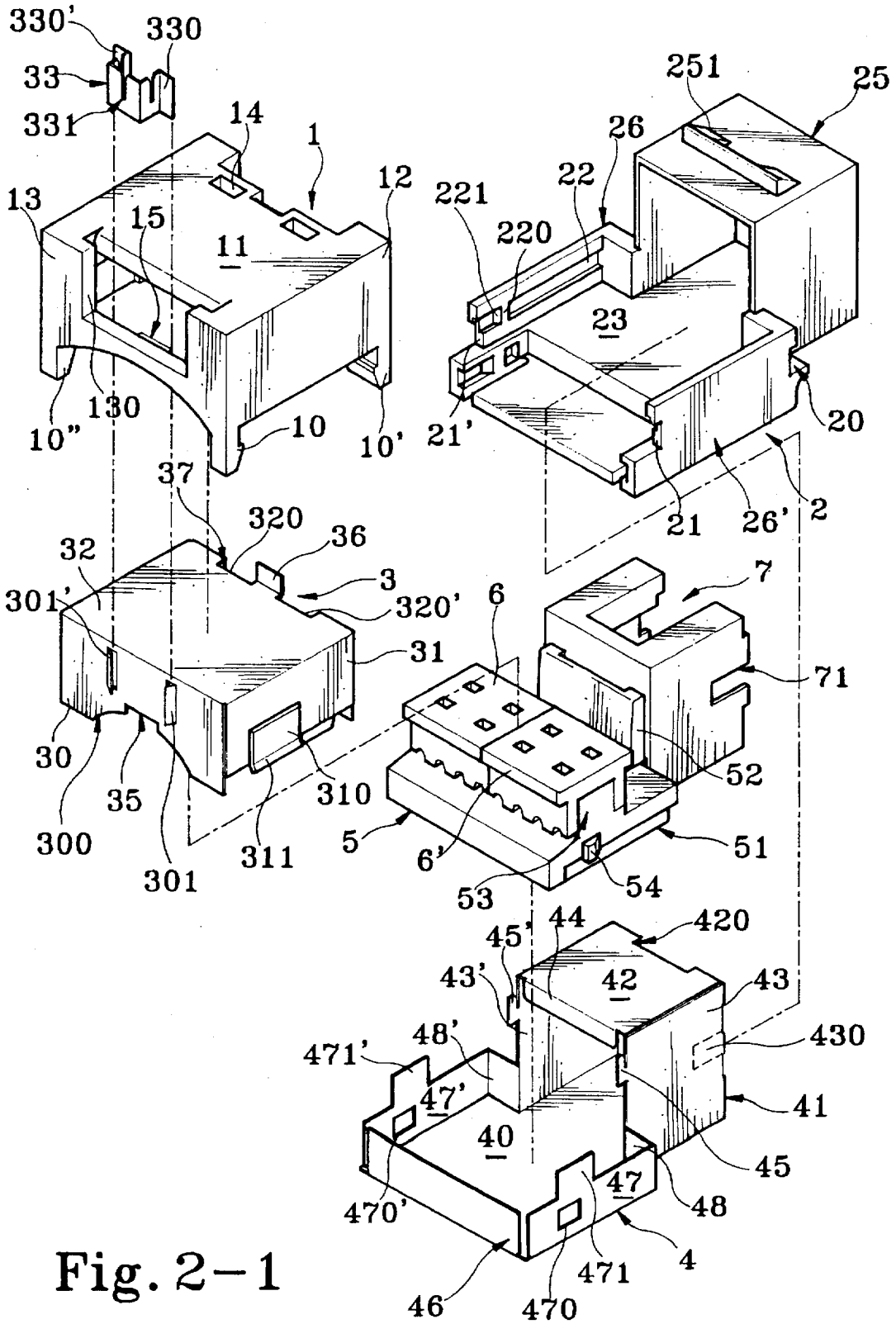
Figure 2:
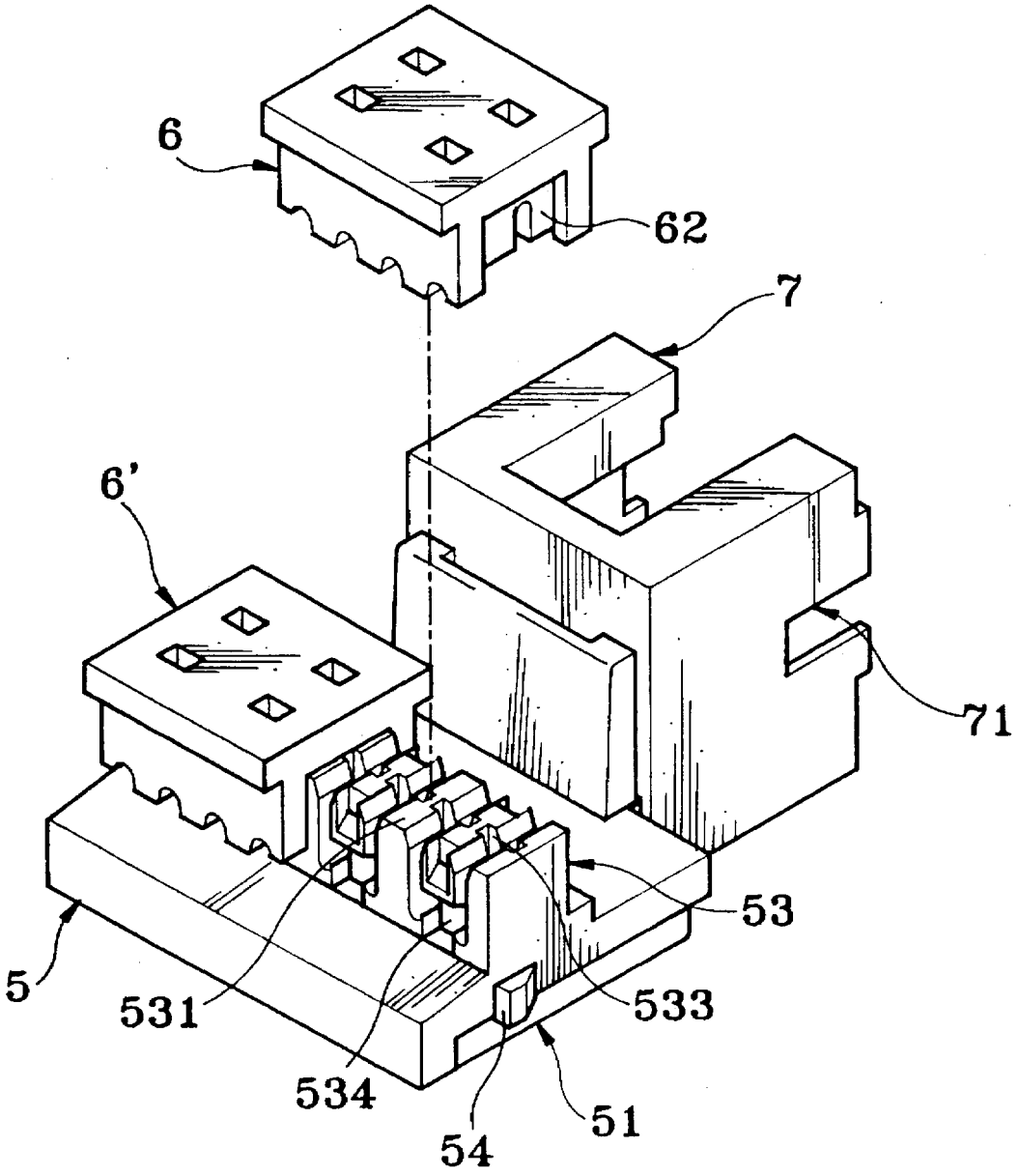
Figures 1, 2, 3:
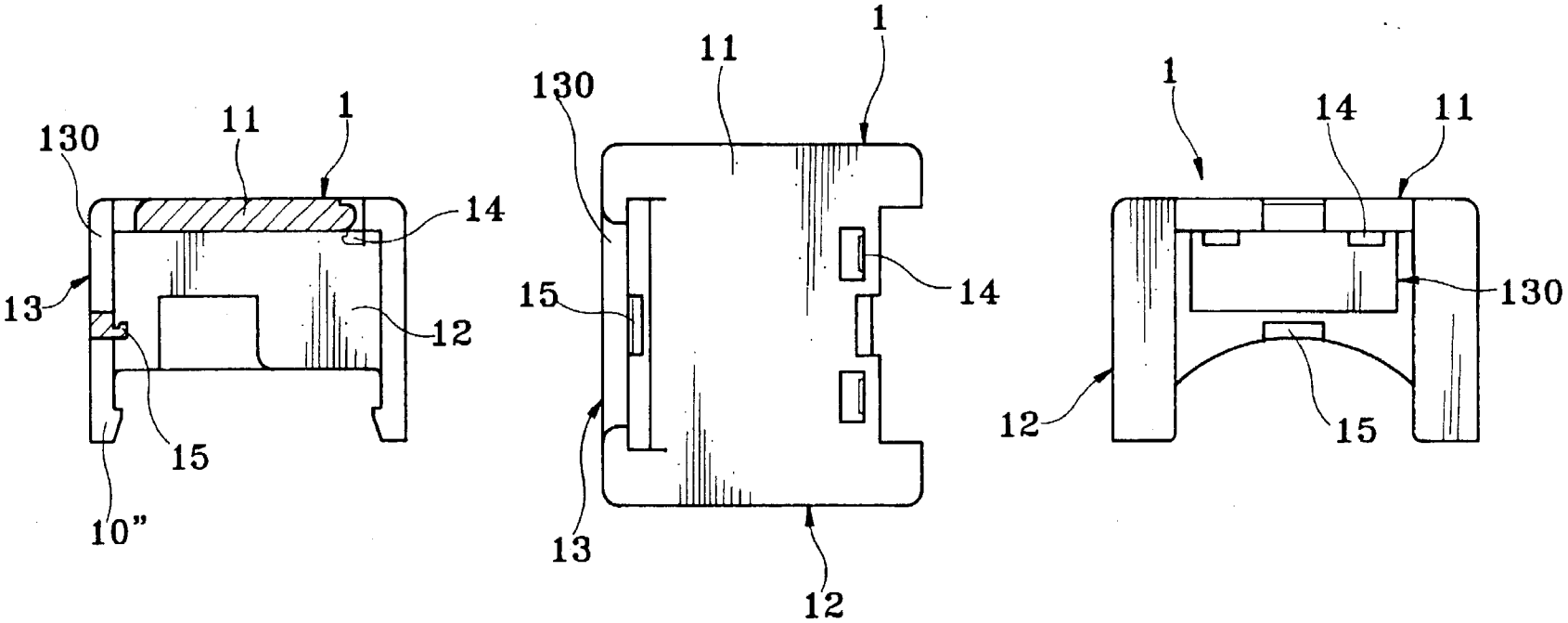
Figures 3, 4:
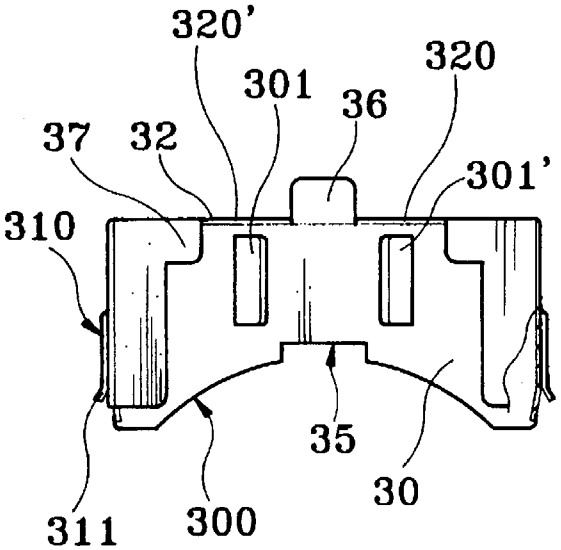
Figures 2, 4:
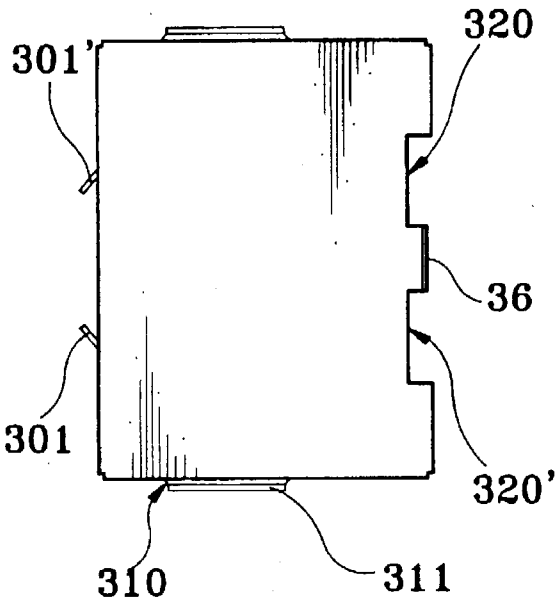
Figures 1, 4:
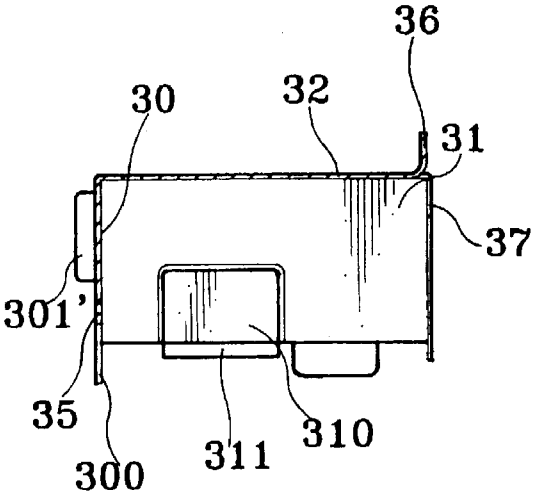

Referring to FIGS. 1, 2-1, and 2—2, an electrical jack assembly in accordance with the present invention comprises jack frame 2 adapted for receiving a modular plug, a top cover 1 covered on the rear side of the jack frame 2 at the top, an electrical connector unit 5 mounted inside the jack frame 2 and adapted for connecting the modular plug to the electrical wires 9*a* (see also FIG. 11-1), and shield means mounted within the jack frame 2 and kept from sight.

The aforesaid electrical connector unit 5 comprises a terminal mounting base frame 51, a plurality of for example two holding-down blocks 6, 6', and a coupling 7 connected to the terminal mounting base frame 51 at the front side.

The aforesaid shield means comprises a shield frame 4 and a cover shell 3. The cover shell 3 and the shield frame 4 are respectively made of metal, adapted for connecting to each other and covering over the electrical connector unit 5. The shield means protect the electrical connections between the electrical connector unit 5, the electrical wires 9*a* and the modular plug against the interference of external magnetic noises.

The base frame 51 of the electrical connector unit 5 is made of electrically insulative material. As shown in Figures from 9-1 to 9-4, the terminal mounting base frame 51 comprises an upright wall 52 in the middle which divides the terminal mounting base frame 51 into a front part and a rear part. The aforesaid coupling 7 is installed in the front part of the terminal mounting base frame 51 in front of the upright wall 52. A conductor mount 53 is formed at the rear part of the terminal mounting base frame 51 behind the upright wall 52, and adapted for holding the electrical wires 9*a*. The conductor mount 53 comprises a plurality of upright blocks 531 arranged in a line and separated from one another by gaps 532, and a plurality of through holes 533 respectively disposed in the gaps 532.

Figures 1, 11:
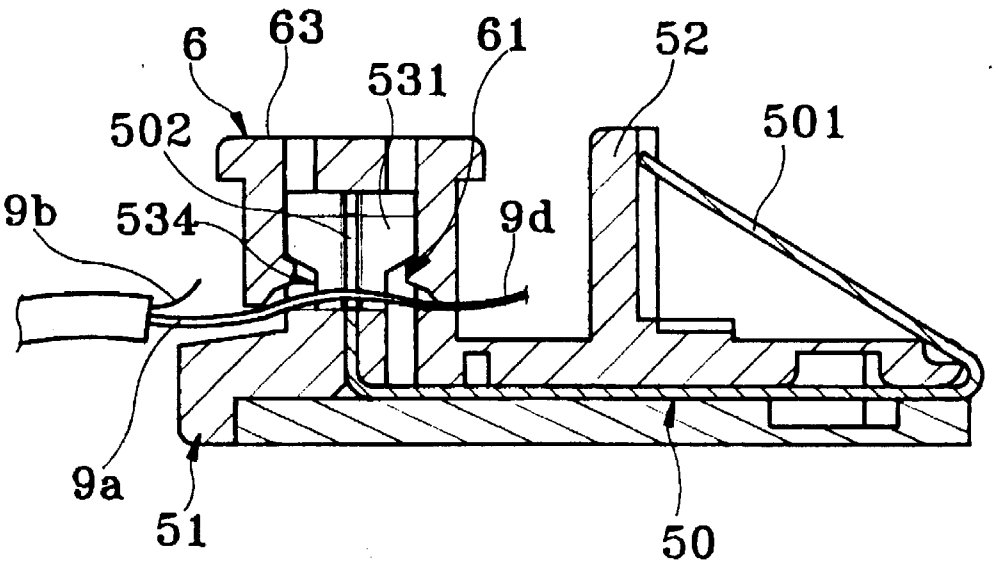
Figures 3, 10:
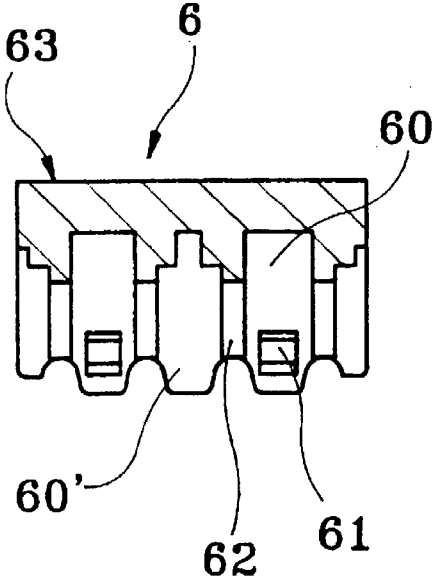
Figures 2, 11:
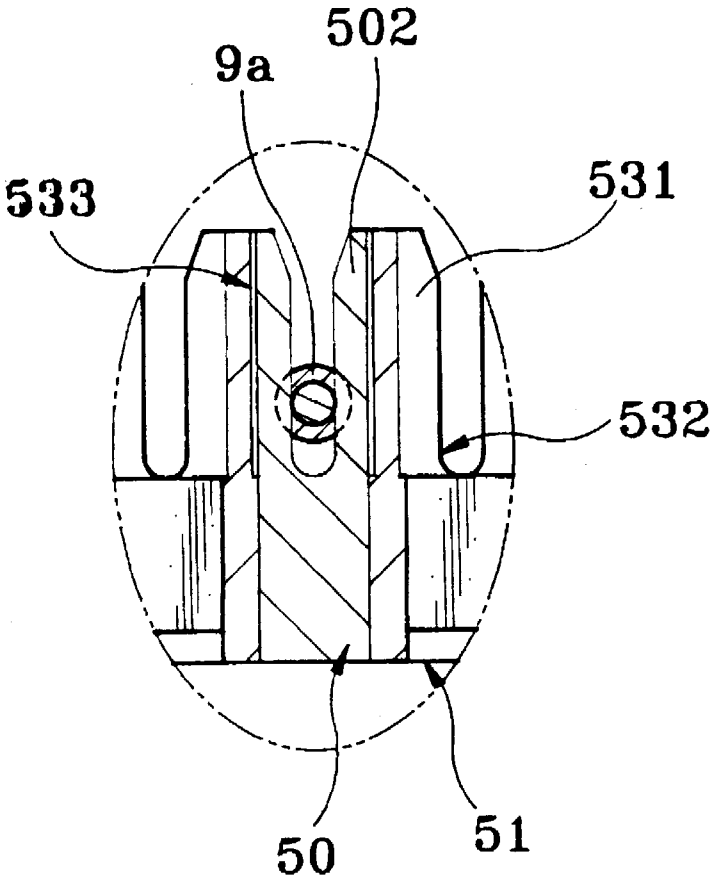

Referring to FIGS. 11-1 and 11-2, a terminal 50 is mounted in the terminal mounting base frame 51, having a front contact end 501 inserted into the inside of the coupling 7 for contact of the corresponding terminal of the modular plug, and a forked, sharp tail end 502 inserted through one through hole 533 and retained in one gap 532. When each electrical wires 9*a* is forced into the corresponding gap 532, the forked, sharp tail end 502 of the terminal 50 is forced to cut through the insulator of the corresponding electrical wire 9*a* and to make electrical contact with the conductor of the corresponding electrical wire 9*a*. Each of the aforesaid upright blocks 531 has a neck 534 near the bottom adapted for coupling the holding-down block 6.

Referring to Figures from 10-1 to 10-3, the holding-down block 6 is made of electrically insulative material, comprising a plurality of holes 60 adapted for receiving the upright blocks 531, a plurality of projecting portions 61 respectively projecting in the holes 60 and adapted for engaging the necks 534 of the upright blocks 531 for permitting the holding-down block 6 to be secured to the conductor mount 53, and a plurality of pressure boards 62 respectively disposed between each two adjacent holes 60, 60' and adapted for press-fitting into the gaps 532. When the holding-down block 6 is fastened to the conductor mount 53, each pressure boards 62 forces the corresponding electrical wire 9*a* against the forked, sharp tail end 502 of the corresponding terminal 50 (see FIG. 11-1). The holding-down block 6 has an expanded top 63 convenient for manipulation with the hand.

When the electrical wires 9*a* are mounted in the conductor mount 53, the tail ends 9*d* of the electrical wires 9*a* are prohibited from contacting the front contact ends 501 of the terminals 50 by the upright wall 52 (see FIG. 11-1). The coupling 7 is a hollow rectangular frame having a forward opening 71 at each lateral wall.

The cover shell 3 and shield frame 4 of the aforesaid shield means are respectively mounted inside the top cover 1 and the jack frame 2. When the top cover 1 is covered on the jack frame 2, the cover shell 3 is simultaneously coupled to the shield frame 4 to shield the aforesaid electrical connector unit 5. The shield frame 4 is made from a metal plate, comprising a bottom frame 40 adapted for carrying the electrical connector unit 5, and a shielding body 41 adapted for shielding the coupling 7. The shielding body 41 comprises two upright side walls 43, 43' bilaterally raised from the bottom frame 40, a top wall 42 connected between the upright side walls 43, 43' in parallel to the bottom frame 40, a downward front flange 420 extended from the front side of the top wall 42 at right angles, two inward spring strips 430 respectively extended from the upright side walls 43, 43', a downward rear flange 44 downwardly extended from the rear side of the top wall 42 at right angles, and two upward fingers 45, 45' respectively raised from the rear sides of the upright side walls 43. When the coupling 7 is mounted in the shielding body 41, the inward spring strips 430 are respectively disposed in the forward openings 71 of the coupling 7 in contact with the metal shell of the modular plug. The bottom frame 40 comprises an upright rear wall 46 raised from the rear side, two upright side walls 47, 47' respectively raised from two lateral sides, and two upright front walls 48, 48' respectively raised from the front side and connected to the rear sides of the upright side walls 43 of the shielding body 41. The upright side walls 47, 47' of the bottom frame 40 have a respective mounting hole 470, 470' facing each other, and a respective upward coupling flange 471, 471' raised from the top.

Figure 8:
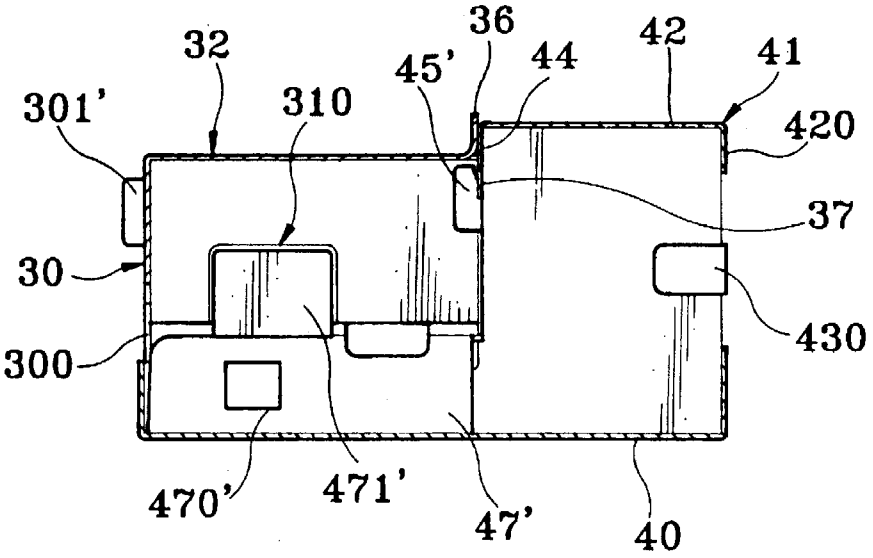
FIG. 8 is a sectional view of a part of the present invention, showing the cover shell and the shielding body connected together.
Figure 7:
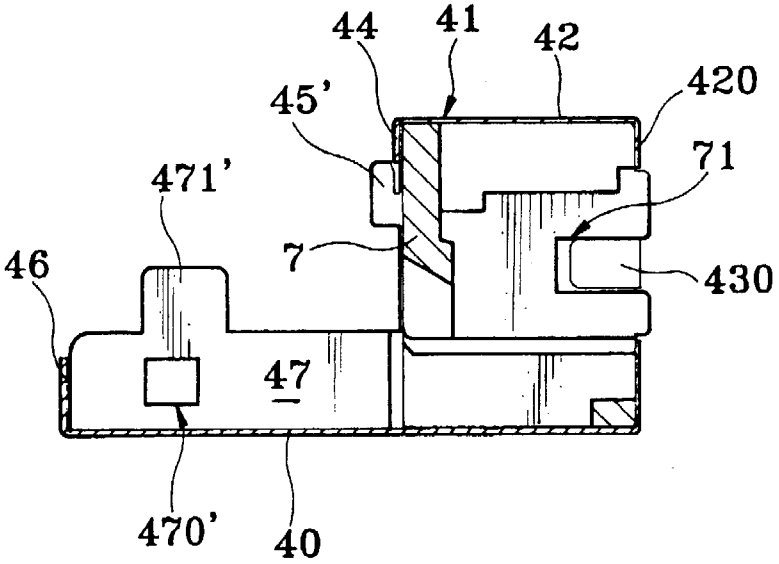
FIG. 7 is a sectional view of a part of the present invention, showing the coupling of the electrical connector unit installed in the shielding body.
Figures 2, 9:
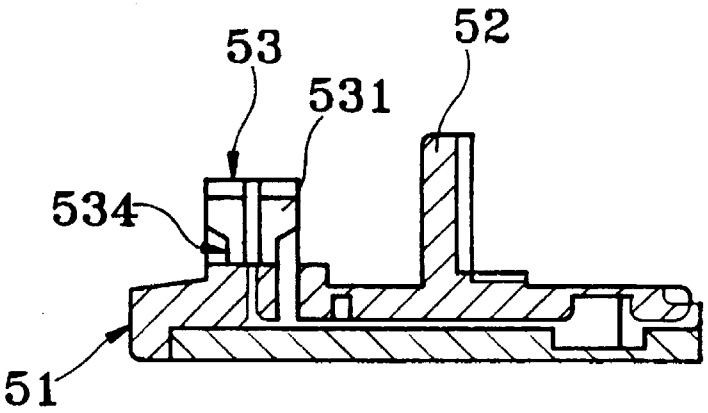
Figures 1, 9:
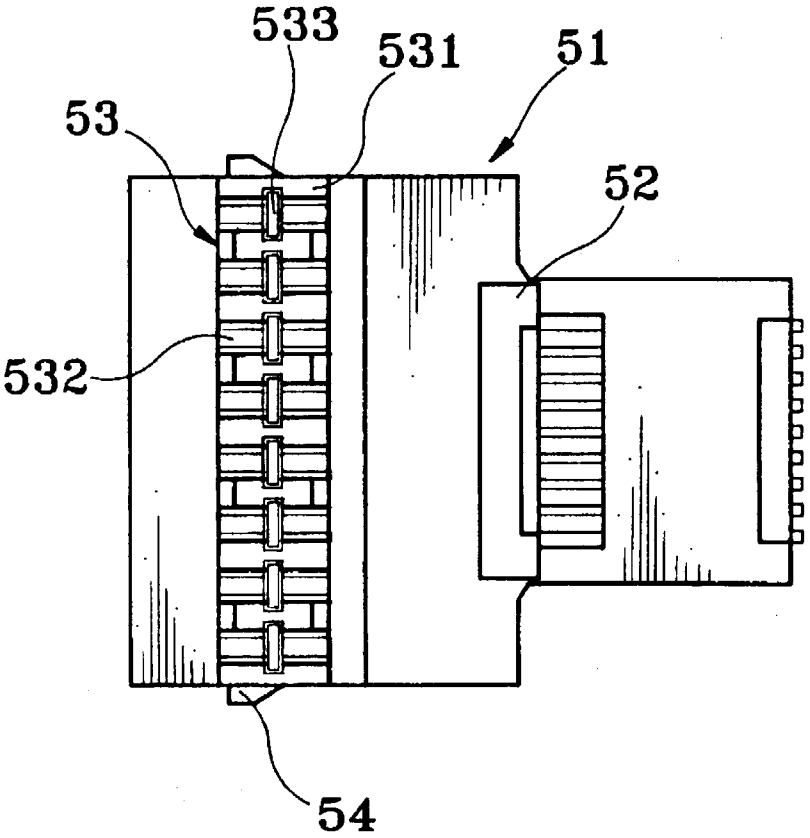
Figures 4, 9:
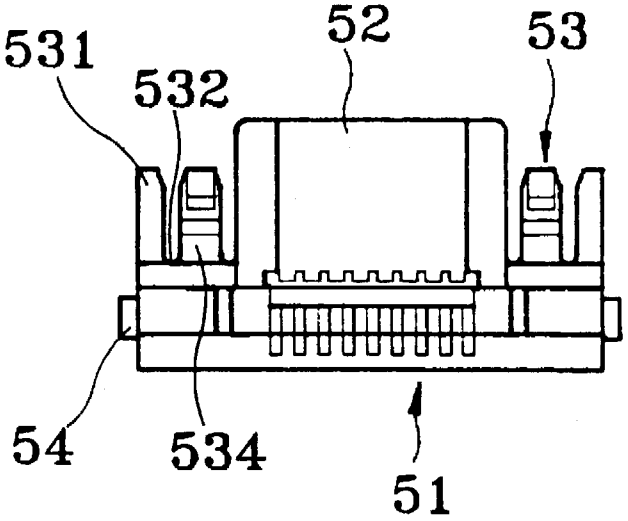
Figures 3, 9:
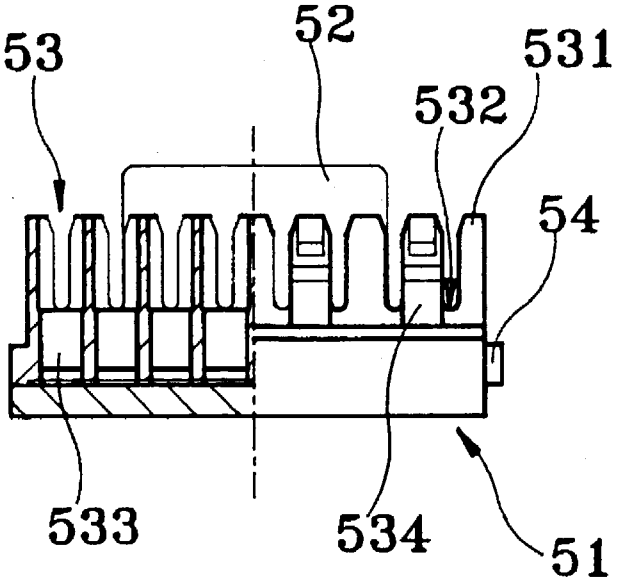
Figures 2, 10:
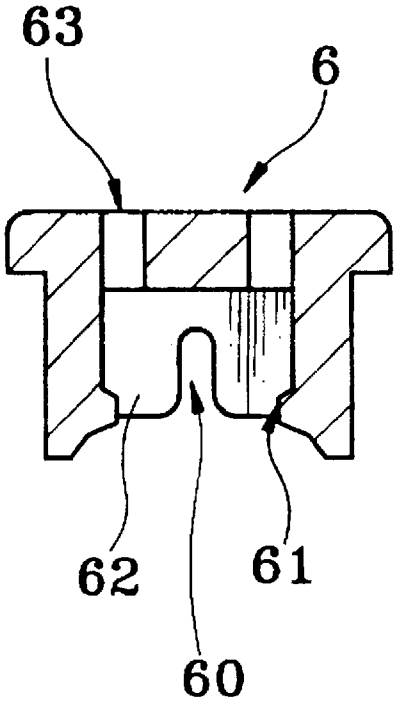
Figures 1, 10:
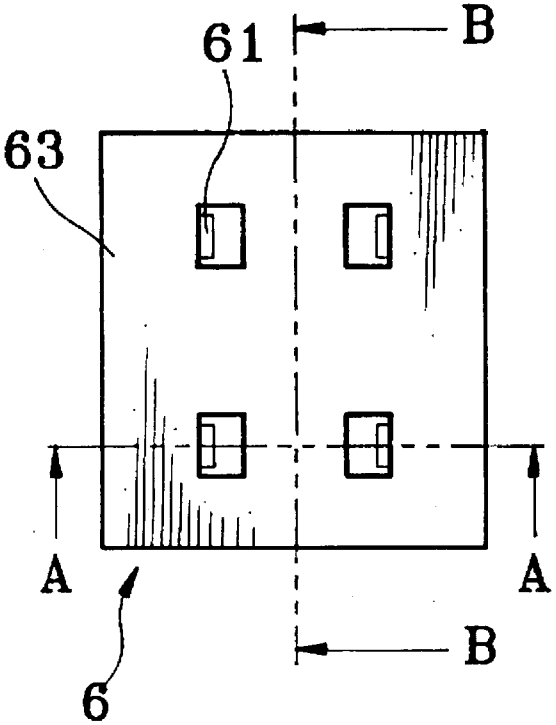

Referring to Figures from 4-1 to 4-3, the cover shell 3 is made from a metal plate and adapted for covering over the rear part of the shield frame 4, comprising a top wall 32, two downward side walls 31 respectively downwardly extended from two opposite lateral sides of the top wall 32 at right angles, and a downward rear wall 30 downwardly extended from the rear side of the top wall 32 at right angles. The rear wall 30 has a downward opening 300 through which the electrical wires 9*a* pass. Two parallel tracks 301, 301' are raised from the rear wall 30 of the cover shell 3 to hold a ground element 33. The ground element 33 comprises two side wings 330, 330' at two opposite sides forced in between the parallel tracks 301, 301', and at least one split 331 adapted for holding one grounding wire 9*b* (see also FIG. 11-1) for permitting the shield means to be electrically connected to ground terminal for protection against external magnetic noises. The downward side walls 31 of the cover shell 3 have a respective convex portion 310 made by stamping and adapted for coupling to the coupling flanges 471, 471' of the shielding body 41. Each convex portion 310 has a sloping bottom edge 311 sloping downwardly outwards adapted for guiding the corresponding coupling flange 471 or 471' into the inside of the convex portion 310 (see also FIG. 8). The top wall 32 of the cover shell 3 has an upward contact flange 36 raised from the front side, and two contact flanges 37 bilaterally disposed at the front side. When the cover shell 3 is coupled to the shield frame 4, the upward contact flange 36 is forced into contact with the downward rear flange 44 of the shield frame 4 (see also FIG. 8).

Figure 5:
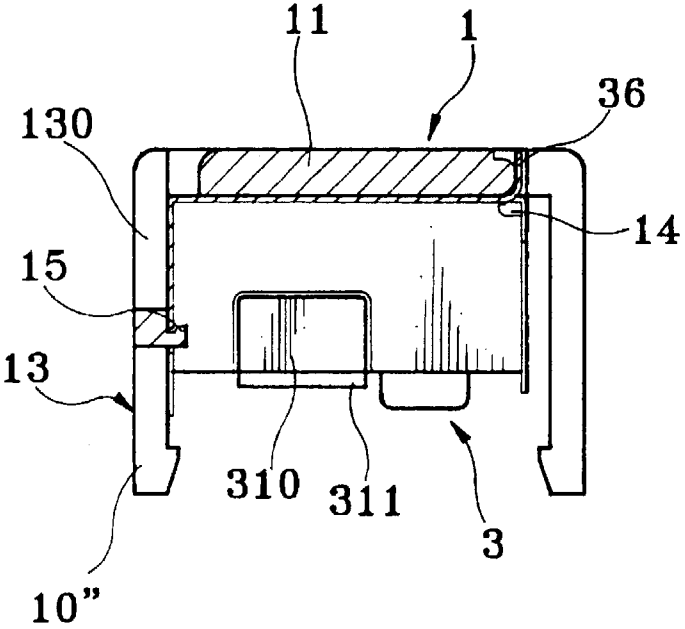
FIG. 5 is a sectional view showing the top cover and the cover shell of the shield means connected together according to the present invention.

Referring to Figures from 3-1 to 3—3, the top cover 1 is a hollow rectangular frame made from electrically insulative material and adapted for covering over the cover shell 3, comprising a top wall 11, two downward side walls 12, a downward rear wall 13, four downward hooks 10 in the four corners adapted for hooking on respective notches 20, 21 of the jack frame 2, and two inside hooks 14 downward raised from the top wall 11 near the front side and adapted for hooking on respective front notches 320, 320' at the front side of the top wall 32 of the cover shell 3. The downward rear wall 13 of the top cover 1 has a center opening 130 extended upward to the topmost edge through which the ground element 33 can be inserted in between the parallel tracks 301, 301'. A hook 15 is raised from the inside surface of the downward rear wall 13, and adapted for hooking in a notch 35 in the middle of the top side of the downward opening 300 of the cover shell 3, for permitting the cover shell 3 to be firmly retained inside the top cover 1 (see also FIG. 5).

Figure 6:
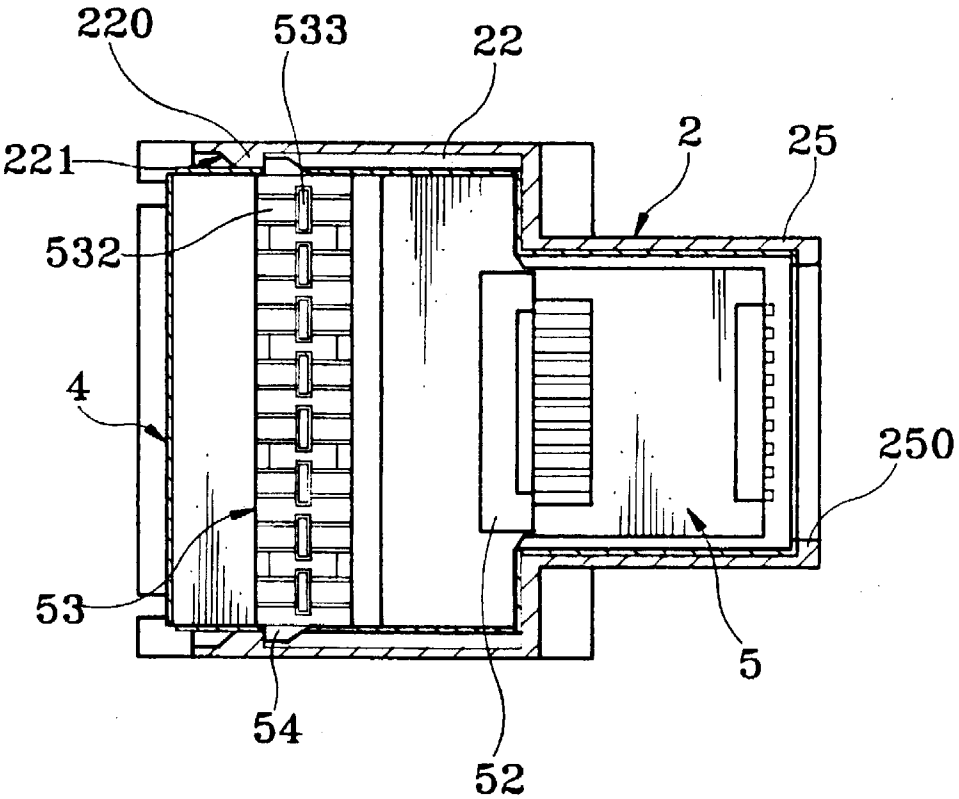
FIG. 6 is a sectional view of a part of the present invention, showing the electrical connector unit and the shielding body installed in the jack frame.

The aforesaid electrical connector unit 5 further comprises two triangular hooks 54 respectively raised from two opposite lateral sides. When the electrical connector unit 5 is mounted on the bottom frame 40 of the shield frame 4, the triangular hooks 54 are respectively forced into engagement with the mounting holes 470, 470' to secure the electrical connector unit 5 and the shield frame 4 together. When the electrical connector unit 5 and the shield frame 4 are connected together, they are horizontally inserted into the jack frame 2 from the rear side, permitting the triangular hooks 54 of the electrical connector unit 5 to be forced into corresponding mounting grooves 22 inside the jack frame 2 (see FIG. 6), and at the same time the coupling 7 is installed in the shielding body 41 of the shield frame 4 and stopped in place by the downward front flange 420.

The aforesaid jack frame 2 has a profile fitting the shield frame 4, comprising a base 23 adapted for carrying the electrical connector unit 5, a front box 25 disposed at the front side of the base 23 and adapted for receiving the shielding body 41 of the shield frame 4, and two upright side walls 26, 26' respectively raised from two opposite lateral sides of the base 23 at right angles. The front box 25 has a stop flange 250 fitting over the downward front flange 420 of the shield frame 4 (see also FIG. 6) for permitting the shielding body 41 of the shield frame 4 to be stopped inside the front box 25. A transverse retaining block 251 is raised from the top side of the front box 25. The transverse retaining block 251 has a slope gradually sloping backwardly upwards for mounting a matched face panel for example a patch panel. The upright side walls 26, 26' have a respective mounting groove 22 horizontally disposed at an inner side, and a respective retaining block 220 vertically disposed in the respective mounting groove 22. The retaining block 220 divides the respective mounting groove 22 into a front part and a rear part, having a bevel edge 221 sloping downwards toward the rear part of the respective mounting groove 22. When the triangular hooks 54 of the electrical connector unit 5 are respectively inserted into the front parts of the mounting grooves 22, they can be forced forwards to pass over the bevel edges 221 of the retaining blocks 220 into the front parts of the mounting grooves 22, and then hooked up with the retaining blocks 220.

The assembly process of the present invention is outlined hereinafter.

i) the terminal mounting base frame 51, holding-down blocks 6 and coupling 7 of the electrical connector unit 5 are mounted on the base frame 40 of the shield frame 4 from the rear side, and then the shield frame 4 with the electrical connector 5 are inserted into the base 23 of the jack frame 2, permitting the triangular hooks 54 of the electrical connector unit 5 to be respectively forced into engagement with the retaining blocks 220 in the mounting grooves 22 of the jack frame 2.

ii) the cover shell 2 is inserted into the top cover 1 from the bottom, and then the terminal element 33 is mounted in between the tracks 301, 301' of the cover shell 3.

iii) the electrical wires **9*a* of the cable 9 are respectively mounted in the gaps 532 of the conductor mount 53, then the holding-down blocks 6 are respectively pressed down to force the electrical wires 9*a* against the forked, sharp tail ends 502 of the terminals 50, thereby causing the forked, sharp tail ends 502 of the terminals 50 to cut into the insulator of the electrical wires 9*a* and to make contact with the conductors of the electrical wires 9*a*** respectively.

iv) the top cover 1 with the cover shell 3 and the ground element 33 are inserted into the rear part of the jack frame 2 from the top, permitting the cover shell 3 to be forced into engagement with the shield frame 4 (see FIG. 8) and the electrical connector unit 5 to be retained on the inside. When assembled, the contact flanges 37 of the cover shell 3 are respectively disposed in contact with the upward fingers 45, 45' of the shield frame 4 (see FIG. 8).

As indicated above, when the electrical jack assembly is assembled, the cover shell 3 and the shield frame 4 are retained inside the top cover 1 and the jack frame 2 and kept from sight, to effectively protect the internal circuit against the interference of external magnetic noises.

While only one embodiment of the present invention has been shown and described, it will be understood that various modifications and changes could be made thereunto without departing from the spirit and scope of the invention disclosed.

I claim:

1. A totally shielded electrical jack assembly adapted for connecting a modular plug to a cable, comprising:

a jack frame adapted for receiving the modular plug, said jack frame comprising a base and a front box in front of said base, wherein the base of said jack frame comprises two upright side walls respectively raised from two opposite lateral sides thereof, and notches in the upright side walls for engagement with the downward hooks of said top cover, and the upright side walls of the base of said jack frame have a respective horizontal mounting groove at an inner side;

a top cover coupled to and covered on the base of said jack frame, wherein said top cover has a plurality of downward hooks respectively fastened to said jack frame;

an electrical connector unit mounted inside said jack frame and adapted for electrically connecting the modular plug to the cable, wherein said electrical connector unit comprises a terminal mounting base frame, and a coupling in front of said terminal mounting base frame for receiving the modular plug, said terminal mounting base frame comprising at least two hooks raised from two opposite lateral sides and respectively forced into engagement with the horizontal mounting grooves of upright side walls of the base of said jack frame; and shield means mounted inside said jack frame, said shield means comprising a shield frame mounted inside said jack frame, and a cover shell mounted in said top cover, said shield frame and said cover shell being made from metal and coupled together and covered around said electrical connector unit to protect it against magnetic noises.

2. The totally shielded electrical jack assembly of claim 1 wherein said top cover comprises a plurality of inside hooks respectively downwardly raised from a top wall thereof and adapted for hooking on a top wall of said cover shell.

3. A totally shielded electrical jack assembly adapted for connecting a modular plug to a cable, comprising:

a jack frame adapted for receiving the modular plug, said jack frame comprising a base and a front box in front of said base;

a top cover coupled to and covered on the base of said jack frame;

an electrical connector unit mounted inside said jack frame and adapted for electrically connecting the modular plug to the cable; and shield means mounted inside said jack frame, said shield means comprising a shield frame mounted inside said jack frame, and a cover shell mounted in said top cover, said shield frame and said cover shell being made from metal and coupled together and covered around said electrical connector unit to protect it against magnetic noises, wherein said shield frame of said shield means comprises a bottom frame adapted for carrying said electrical connector unit, and a shielding body adapted for shielding a coupling of said electrical connector unit, said shielding body comprising two upright side walls bilaterally raised from said bottom frame, a top wall connected between the upright side walls of said shielding body in parallel to said bottom frame, a downward front flange extended from a front side of the top wall of said shielding body at right angles, two inward spring strips respectively extended from the upright side walls of said shielding body and adapted for contacting the metal shell of the modular plug, a downward rear flange downwardly extended from a rear side of the top wall of said shielding body at right angles, and two upward fingers respectively raised from respective rear sides of the upright side walls of said shielding body, said bottom frame comprising an upright rear wall, two upright side walls respectively raised from two lateral sides, and two upright front walls respectively raised from a front side and connected to the upright side walls of said shielding body, the upright side walls of said bottom frame having a respective mounting hole for coupling to the terminal mounting base frame of said electrical connector unit, and a respective upward coupling flange for coupling to said cover shell of said shield means.

4. A totally shielded electrical jack assembly adapted for connecting a modular plug to a cable, comprising:

a jack frame adapted for receiving the modular plug, said jack frame comprising a base and a front box in front of said base;

a top cover coupled to and covered on the base of said jack frame;

an electrical connector unit mounted inside said jack frame and adapted for electrically connecting the modular plug to the cable; and shield means mounted inside said jack frame, said shield means comprising a shield frame mounted inside said jack frame, and a cover shell mounted in said top cover, said shield frame and said cover shell being made from metal and coupled together and covered around said electrical connector unit to protect it against magnetic noises, wherein said cover shell of said shield means comprises a top wall, two downward side walls respectively downwardly extended from two opposite lateral sides of the top wall of said cover shell at right angles, and a downward rear wall downwardly extended from a rear side of the top wall of said cover shell at right angles, the rear wall of said cover shell having a downward opening said cable passes, two parallel tracks vertically disposed at an outer side, and a ground element mounted in between said parallel tracks, the downward side walls of said cover shell having a respective convex portion adapted for coupling to the flanges of said shielding body, the top wall of said cover shell having an upward contact flange raised from a front side thereof and adapted for contacting a downward rear flange of said shield frame.

* * * * *